US012577845B2

(12) United States Patent
Helvenston et al.

(10) Patent No.: US 12,577,845 B2
(45) Date of Patent: Mar. 17, 2026

(54) WELLHEAD COMPRESSION RELIEF SYSTEM

(71) Applicant: VAULT PRESSURE CONTROL, LLC, Houston, TX (US)

(72) Inventors: Andrew Browne Helvenston, Houston, TX (US); Khang Van Nguyen, Tomball, TX (US); Bryan Staton, Houston, TX (US)

(73) Assignee: VAULT PRESSURE CONTROL, LLC, Houston, TX (US)

( * ) Notice: Subject to any disclaimer, the term of this patent is extended or adjusted under 35 U.S.C. 154(b) by 17 days.

(21) Appl. No.: 18/899,040

(22) Filed: Sep. 27, 2024

(65) Prior Publication Data

US 2025/0101827 A1 Mar. 27, 2025

Related U.S. Application Data

(60) Provisional application No. 63/585,813, filed on Sep. 27, 2023.

(51) Int. Cl.
*E21B 33/04* (2006.01)

(52) U.S. Cl.
CPC ..... *E21B 33/04* (2013.01)

(58) Field of Classification Search
CPC ..... E21B 33/04
See application file for complete search history.

(56) References Cited

U.S. PATENT DOCUMENTS

| | | | | |
|---|---|---|---|---|
| 3,220,251 | A * | 11/1965 | Pearson | E21B 45/00 73/152.44 |
| 3,874,706 | A | 4/1975 | Arnold | |
| 6,062,312 | A | 5/2000 | Wilkins | |
| 6,209,633 | B1 * | 4/2001 | Haynes | E21B 19/086 166/77.51 |
| 2003/0168857 | A1 | 9/2003 | Jennings | |
| 2015/0083430 | A1 | 3/2015 | Jahnke et al. | |

OTHER PUBLICATIONS

Patent Cooperation Treaty; International Searching Authority, PCT? US2024/048795; Dec. 12, 2024.

* cited by examiner

*Primary Examiner* — Dany E Akakpo
(74) *Attorney, Agent, or Firm* — Morgan, Lewis & Bockius LLP

(57) ABSTRACT

A compression relief tool includes a tool body, an actuator, and a tool sleeve. The tool body is configured to couple to a wellhead. The actuator is coupled to the tool body and is configured to be coupled to the wellhead. The actuator is further configured to impart a preload force on an intermediate casing via the tool body. The tool sleeve is movable relative to the tool body. The tool sleeve is configured to engage a retaining ring coupled to the intermediate casing. The tool sleeve is movable to retrieve the retaining ring from the intermediate casing. The actuator is configured to release the preload force on the intermediate casing after the tool sleeve retrieves the retaining ring.

20 Claims, 10 Drawing Sheets

WELLHEAD COMPRESSION RELIEF SYSTEM

TECHNICAL FIELD

The present disclosure relates to tools and methods used in oil and gas operations, and in particular to systems and methods for casing systems used in oil and gas operations.

BACKGROUND

In exploration and production of formation minerals, such as oil and gas, wellbores may be drilled into an underground formation. The wellbores may be cased wellbores where a casing (or tubular piping string) is positioned against a wall of the borehole, where cement may be injected to secure the casing string to the formation. A casing string is typically supported at its upper end by a casing hanger, which is located (or landed) within a wellhead at the surface. At the lower end, the casing string is connected to the wellbore to connect the pressurized well to the surface.

In some applications, the area of land around the wellbore may subside, sink, or settle. The subsidence of the land can cause the wellhead, the conductor casing, and/or the surface casing to move downward with the land. The downward movement of the wellhead, the conductor casing, and/or the surface casing can compress the intermediate casing coupled to, or otherwise attached to the wellhead, conductor casing, and/or the surface casing. In some applications, the compression of the surface casing accumulates over time.

The compression of the intermediate casing may be relieved to allow for maintenance, remediation, decommissioning, or other well operations. In certain conventional applications, a lock mechanism can be released relative to the wellhead to allow compression on the intermediate casing to be relieved. Certain conventional lock or release mechanism may be difficult and time consuming to use, may introduce leak paths, and may reduce the integrity of wellhead components.

Therefore, what is needed is an apparatus, system or method that addresses one or more of the foregoing issues, among one or more other issues.

SUMMARY

A compression relief tool includes a tool body, an actuator, and a tool sleeve. The tool body is configured to couple to a wellhead. The actuator is coupled to the tool body and is configured to be coupled to the wellhead. The actuator is further configured to impart a preload force on an intermediate casing via the tool body. The tool sleeve is movable relative to the tool body. The tool sleeve is configured to engage a lock ring and/or a retaining ring coupled to the intermediate casing. The tool sleeve is movable to retrieve the lock ring and/or the retaining ring from the intermediate casing. The actuator is configured to release the preload force on the intermediate casing after the tool sleeve retrieves the lock ring and/or the retaining ring.

In another embodiment, the tool sleeve is configured to engage a retaining ring coupled to the intermediate casing and the tool sleeve is movable to retrieve the retaining ring from the intermediate casing.

In another embodiment, the actuator is configured to release the preload force on the intermediate casing after the tool sleeve retrieves the retaining ring.

In another embodiment, the tool body is configured to be coupled to the wellhead via a wellhead adapter coupled to the wellhead.

In another embodiment, the actuator is configured to release the preload force at a predetermined rate.

In another embodiment, the retaining ring is inwardly biased.

In another embodiment, the retaining ring is outwardly biased.

In another embodiment, at least one of the retaining ring and the tool sleeve comprises collet fingers.

In another embodiment, the actuator comprises threaded bolts configured to couple to a tool flange of the wellhead.

In another embodiment, the compression relief tool further comprises a test port.

In another embodiment, the compression relief tool further comprises a hydraulic piston configured to move the movable sleeve.

In another embodiment, the actuator comprises a hydraulic piston.

In another embodiment, the compression relief tool further comprises lockdown screws configured to engage with mating notches formed in the tool body.

In another embodiment, the compression relief tool further comprises a hydraulic locking mechanism configured to actuate locking members to engage mating grooves formed in the wellhead adapter.

A method of compression relief may comprise the steps of coupling a tool body to a wellhead, coupling an actuator to the tool body, actuating the actuator to impart a preload force on an intermediate casing via the tool body, moving a tool sleeve relative to the tool body to release a lock ring from the intermediate casing, and releasing the preload force on the intermediate casing after the tool sleeve releases the lock ring.

In another embodiment, the method further comprises the steps of using the tool sleeve to engage a retaining ring coupled to the intermediate casing and moving the tool sleeve to retrieve the retaining ring from the intermediate casing.

The compression relief tool simplifies releasing compressive forces imparted on an intermediate casing and eliminates the need for set screws that are utilized to retain or couple the intermediate casing to the wellhead.

BRIEF DESCRIPTION OF DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The present disclosure relates generally to tools and methods used in oil and gas operations, and more particularly, to systems and methods for casing systems used in oil and gas operations. As described herein, embodiments of the tool described herein improves upon the traditional methods of relieving compressive forces on intermediate casing.

Certain conventional applications may utilize one or more set screws to secure wellhead components. The use of set screws may be difficult and time consuming, may introduce leak paths, and may reduce the integrity of wellhead components.

Embodiments of disclosed casing system and release tool can utilize a lock ring, a retaining ring and/or e-ring to selectively couple the intermediate casing to the wellhead. Advantageously, the disclosed release tool can release the lock ring, retaining ring, and/or e-ring to allow the intermediate casing to be relieved of compressive force in a controlled, simplified, and expedient manner without using or releasing set screws, which may be difficult and time consuming, may introduce leak paths, and may reduce the integrity of wellhead components.

Figure 1:
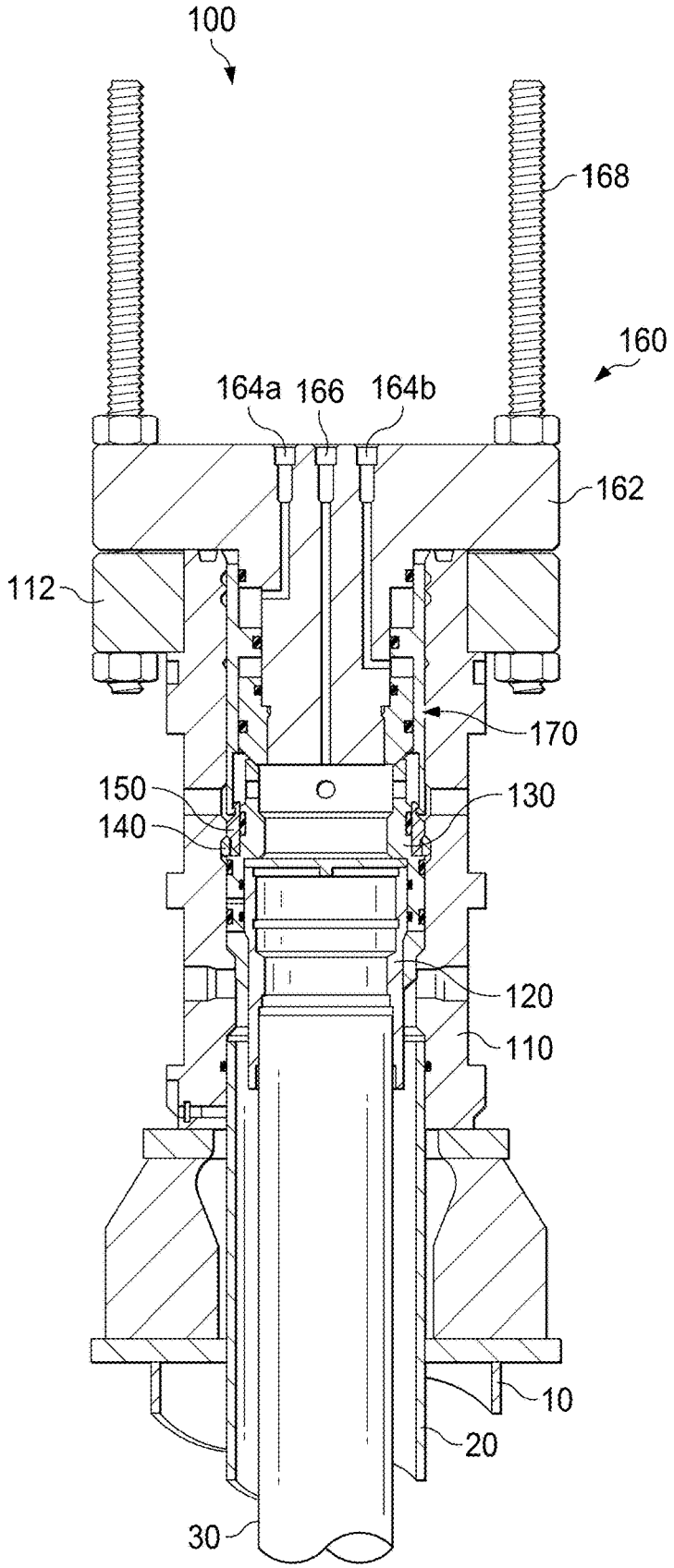
FIG. 1 is a cross-sectional view of an example configuration of a wellhead system, in accordance with embodiments of the present disclosure.

FIG. 1 is a cross-sectional view of an example configuration of a wellhead system 100, in accordance with embodiments of the present disclosure. With reference to FIG. 1, the wellhead 110 can be used to control the flow of fluids to and from a wellbore. As illustrated in FIG. 1, the wellhead 110 is supported by the conductor casing 10 and/or the surface casing 20. In some embodiments, certain aspects of installing the wellhead may be described in U.S. Pat. No. 9,534,465 and is incorporated herein by reference.

In the depicted example, the hanger 120 can provide fluid communication between the wellhead 110, the intermediate casing 30, and the wellbore. In some embodiments, a pack off 130 can be installed to fluidly isolate the intermediate casing 30 and/or the wellbore from the wellhead 110. As illustrated, the intermediate casing 30 and the pack off 130 can be coupled to the wellhead 110 by a lock ring 140. In some embodiments, the lock ring 140 can be energized or forced into engagement with the wellhead 110 by an e-ring or retaining ring 150 disposed between the lock ring 140 and the pack off 130. In some embodiments, the lock ring 140 can be engaged with the wellhead 110 without the use of a retaining ring.

In some applications, the area of land around the wellbore may subside, sink, or settle. The subsidence of the land can cause the wellhead 110, the conductor casing 10, and/or the surface casing 20 to move downward with the land. The downward movement of the wellhead 110, the conductor casing 10, and/or the surface casing 20 can compress the intermediate casing 30 that is coupled to, or otherwise attached to the wellhead 110. In some applications, the compression of the surface casing accumulates over time.

In some applications, the compression of the intermediate casing 30 can be relieved to allow for maintenance, remediation, decommissioning, or other well operations. In the depicted example, a compression relief tool 160 can relieve compressive forces on the intermediate casing 30. As described herein, the compression relief tool 160 can apply a preload force on the intermediate casing 30, release or separate the intermediate casing 30 from the wellhead 110, and permit the expansion of the intermediate casing 30.

During operation, the compression relief tool 160 is coupled to the wellhead 110. As illustrated, the compression relief tool 160 can be coupled to a tool flange 112 of the wellhead 110. In some embodiments, threaded bolts or rods 168 are used to couple or secure the compression relief tool 160 to the wellhead 110. Optionally, a test port 166 can relieve pressure within the wellbore.

In the depicted example, the compression relief tool 160 can apply a preload force against the intermediate casing 30. As illustrated, the tool body 162 can be advanced to impart a preload force against the pack off 130 and ultimately the intermediate casing 30. In some embodiments, the threaded bolts or rods 168 can be rotated or otherwise actuated to impart a preload force against the intermediate casing 30 via the tool body 162.

Figure 2:
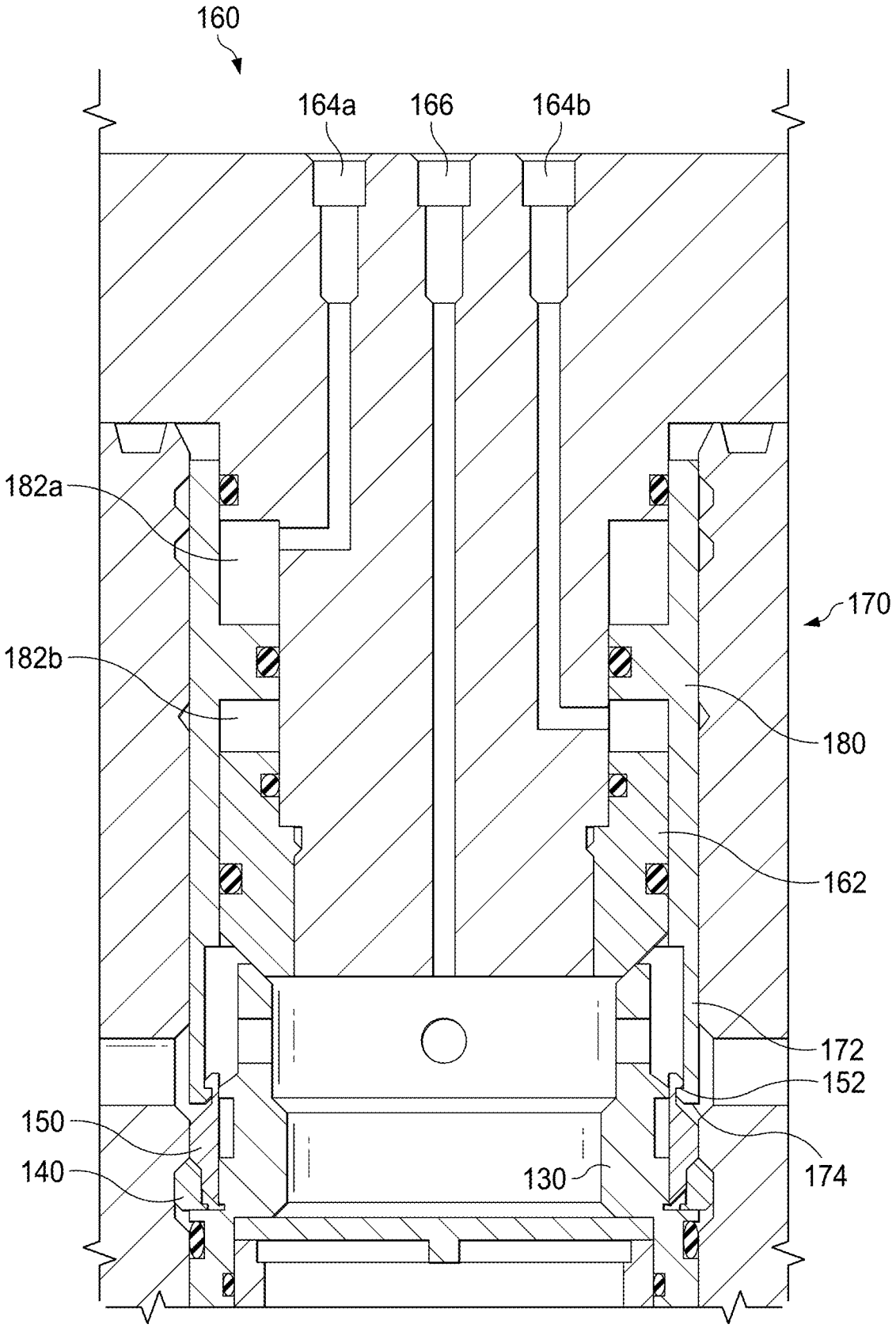
FIG. 2 is a cross-sectional view of the release tool depicted in FIG. 1 in an extended position.

FIG. 2 is a cross-sectional view of the compression relief tool 160 depicted in FIG. 1 in an extended position. With reference to FIGS. 1 and 2, the compression relief tool 160 can disengage the lock ring 140 to decouple or separate the intermediate casing 30 from the wellhead 110. In the depicted example, the compression relief tool 160 includes a sleeve assembly 170 that is movable to engage and retrieve the retaining ring 150, which in turn releases the lock ring 140, separating the intermediate casing 30 from the wellhead 110. In some embodiments, the sleeve assembly 170 can engage, release, and retrieve the lock ring 140 directly.

As illustrated, the sleeve assembly 170 includes a movable sleeve 172 that is configured to engage with the retaining ring 150. In some embodiments, the movable sleeve 172 includes engagement ramps or fingers 174 to engage with a mating feature or groove 152 of the retaining ring 150. In some embodiments, the movable sleeve 172 and/or the retaining ring 150 can include flexible collet "fingers" that flex into position and engage.

During operation, the movable sleeve 172 can be moved downward to engage with the retaining ring 150. In some embodiments, the movable sleeve 172 can be moved hydraulically. As illustrated, hydraulic fluid can actuate a piston 180 to move the movable sleeve 172. For example, hydraulic fluid introduced into chamber **182*a* can move the piston 180 downward, causing the movable sleeve 172 to engage with the retaining ring 150. Hydraulic fluid can be delivered to the chamber 182*a* via hydraulic line 164*a* formed in the tool body 162**.

Figure 3:
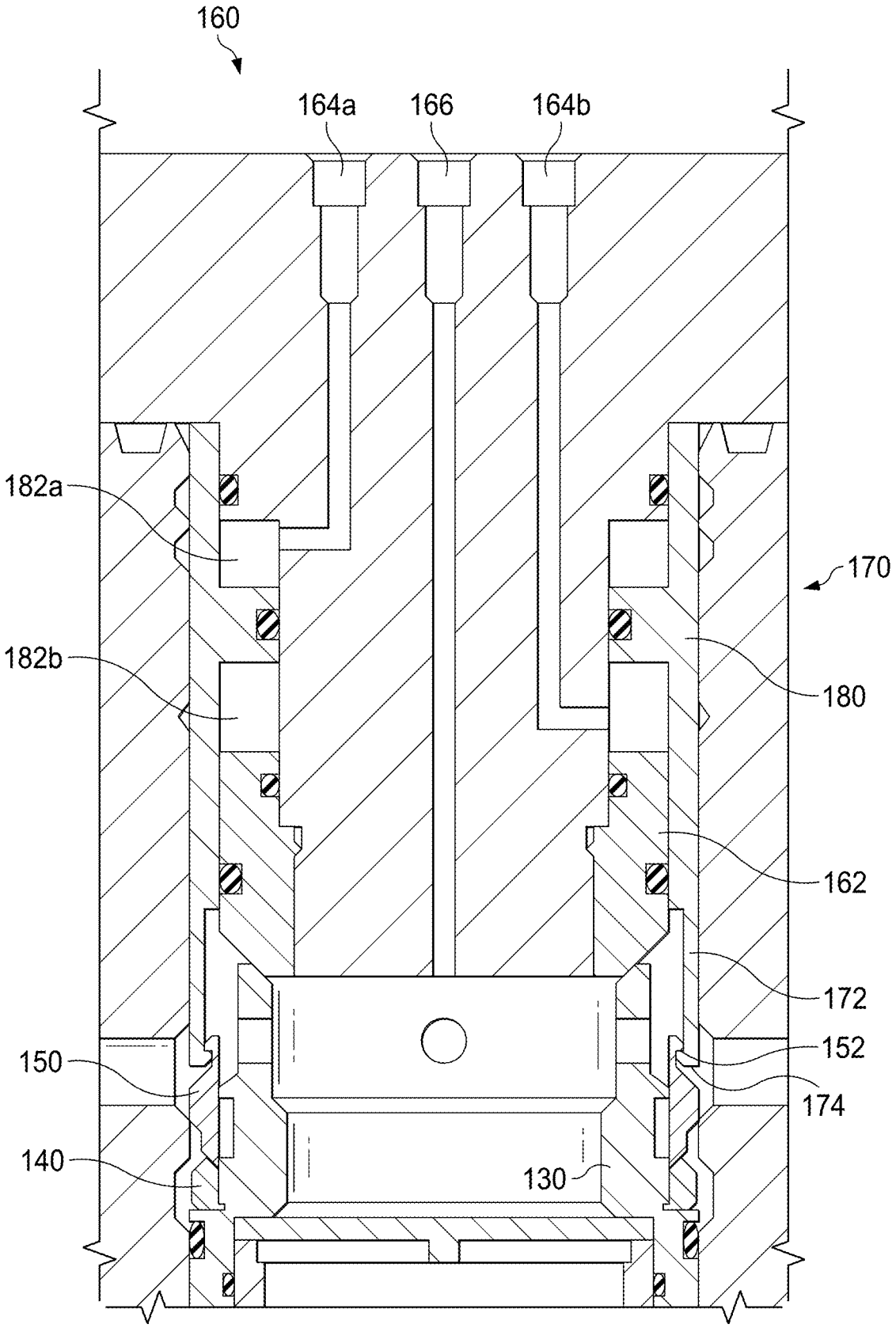
FIG. 3 is a cross-sectional view of the release tool depicted in FIG. 1 in a retracted position.

FIG. 3 is a cross-sectional view of the compression relief tool 160 depicted in FIG. 1 in a retracted position. As illustrated, the movable sleeve 172 can be actuated to retract or disengage the retaining ring 150 from the lock ring 140. After the movable sleeve 172 has engaged with the retaining ring 150, the movable sleeve 172 can be moved or actuated upward to retrieve the retaining ring 150. After the retaining ring 150 is retrieved from between the lock ring 140 and the pack off 130, the lock ring 140 is released, disengaging or separating the intermediate casing 30 from the wellhead. In this particular embodiment, the lock ring 140 is inwardly biased. Accordingly, the retaining ring 150 is disposed between the lock ring 140 and pack off 130, such that, once retaining ring 150 is removed, the inward bias of lock ring 140 will cause it to disengage from the intermediate casing 30. One of ordinary skill in the art will understand that the present invention is not limited to this configuration, but could also be used with a lock ring that is outwardly biased. In some embodiments, the movable sleeve 172 can engage and retrieve the lock ring 140 to disengage the intermediate casing 30 from the wellhead.

As described herein, hydraulic fluid can actuate the piston 180 to retrieve the retaining ring 150. During operation, hydraulic fluid introduced into chamber 182*b* can move the piston 180 upward, causing the movable sleeve 172 to move upward and retrieve the retaining ring 150. Hydraulic fluid can be delivered to the chamber 182*b* via hydraulic line 164*b* formed in the tool body 162.

Figure 4:
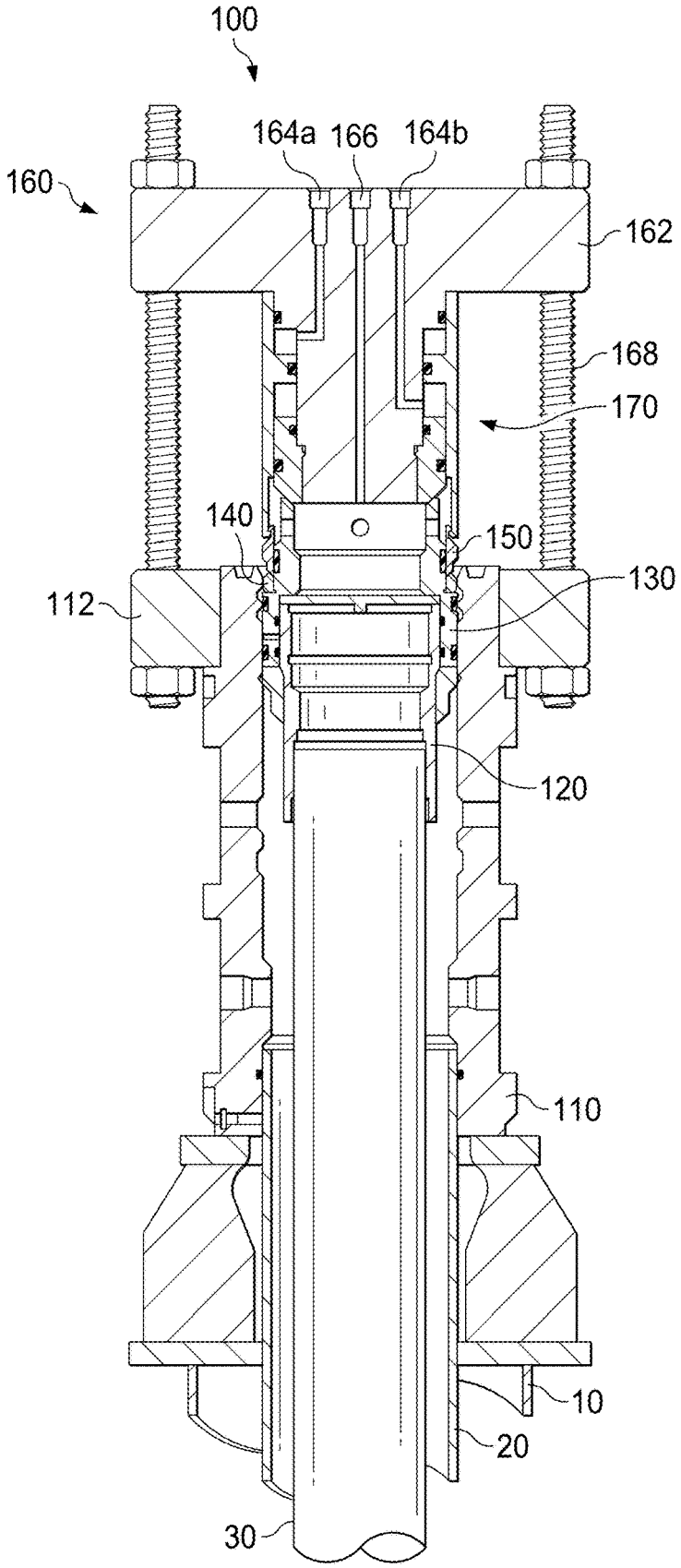
FIG. 4 is a cross-sectional view of the wellhead system of FIG. 1 in a compression relief configuration.

FIG. 4 is a cross-sectional view of the wellhead system 100 of FIG. 1 in a compression relief configuration. After the retaining ring 150 and/or lock ring 140 is released and the intermediate casing 30 is separated from the wellhead 110, the compression relief tool 160 can release the compressive force on the intermediate casing 30. In the depicted example, the tool body 162 of the compression relief tool 160 can be retracted relative to the wellhead 110 to allow the intermediate casing 30 expand in a controlled manner or predetermined rate. In some embodiments, the threaded bolts or rods 168 can be rotated or otherwise actuated to release the compressive force stored in the intermediate casing 30. As illustrated, the intermediate casing 30 can rise relative to the wellhead 110.

Figure 5:
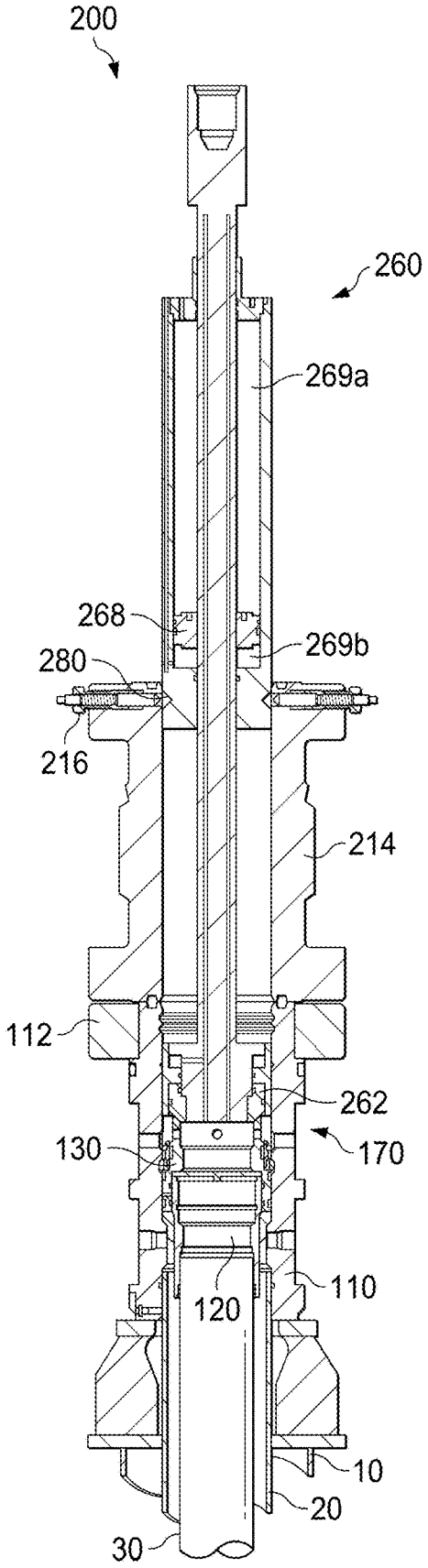
FIG. 5 is a cross-sectional view of an example configuration of a wellhead system, in accordance with embodiments of the present disclosure.

FIG. 5 is a cross-sectional view of an example configuration of a wellhead system 200, in accordance with embodiments of the present disclosure. With reference to FIG. 5, the wellhead system 200 includes an adapter 214 coupled to the wellhead 110.

Figure 6:
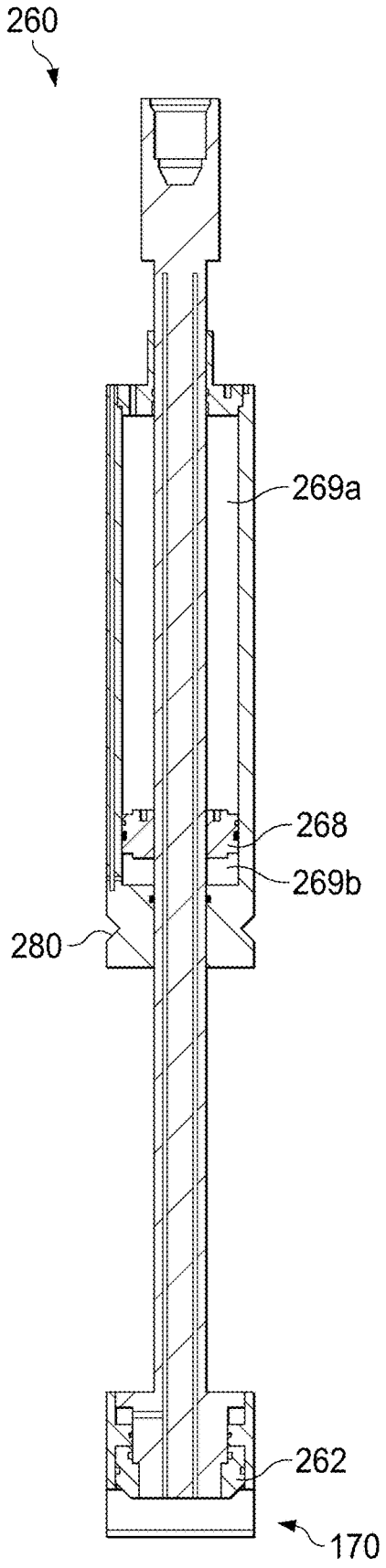
FIG. 6 is a cross-sectional view of the release tool depicted in FIG. 5.

FIG. 6 is a cross-sectional view of the compression relief tool 260 depicted in FIG. 5. With reference to FIGS. 5 and 6, the compression relief tool 260 can be deployed through the adapter 214 to relieve compressive forces on the intermediate casing 30. As described herein, the compression relief tool 260 can be coupled to the adapter 214 and hydraulically apply a preload force on the intermediate casing 30. In some applications, certain features of the compression relief tool 260 are similar to the features of the compression relief tool 160 and may be referenced with similar reference numerals.

Figure 7:
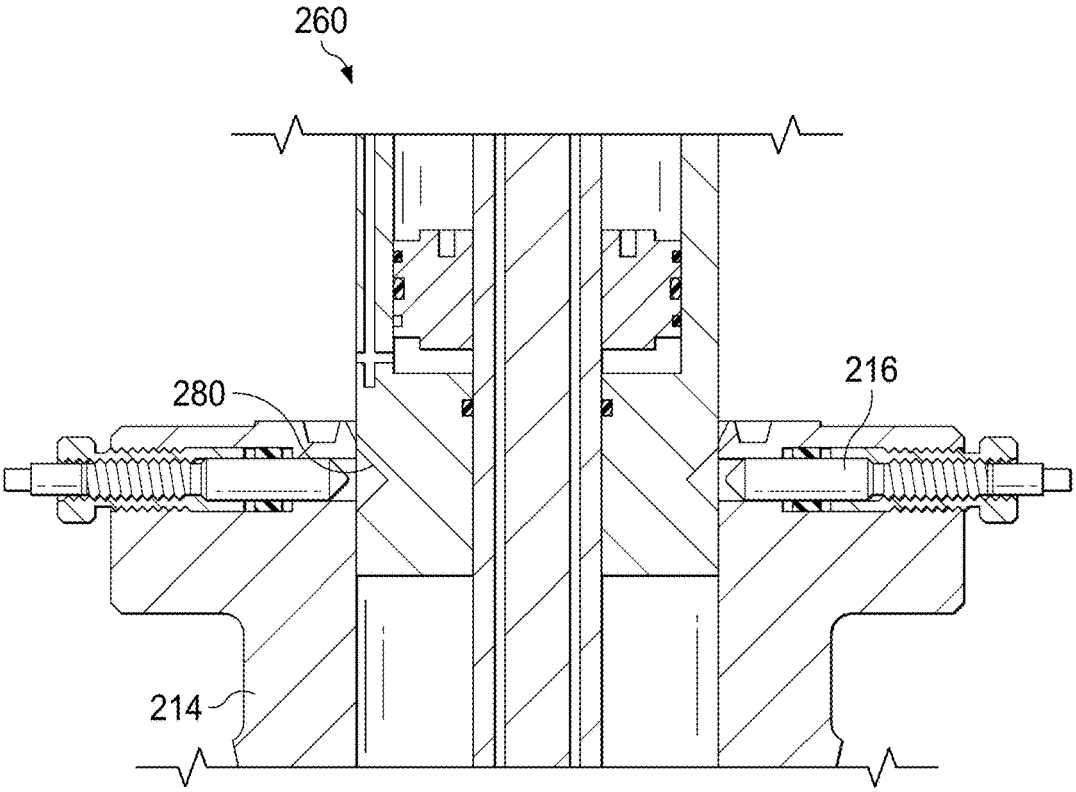
FIG. 7 is a cross-sectional detail view of the release tool depicted in FIG. 5.

FIG. 7 is a cross-sectional detail view of the compression relief tool 260 depicted in FIG. 5. With reference to FIGS. 5-7, the compression relief tool 260 can be coupled to the adapter 214. As illustrated, the compression relief tool 260 can be deployed through an opening or cavity of the adapter 214 and coupled to the adapter 214 using one or more lockdown screws 216. In the depicted example, the lockdown screws 216 can engage with mating notches 280 formed in the body of the compression relief tool 260 to secure the compression relief tool 260 relative to the adapter 214 and wellhead 110.

Figure 8:
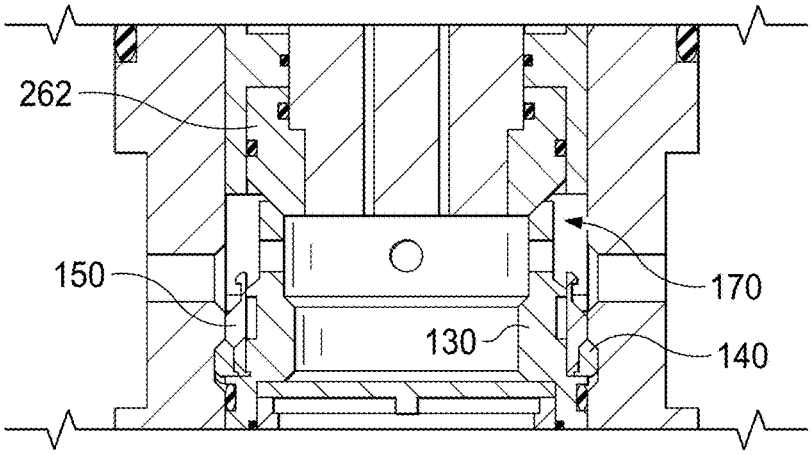
FIG. 8 is a cross-sectional detail view of the release tool depicted in FIG. 5.

FIG. 8 is a cross-sectional detail view of the compression relief tool 260 depicted in FIG. 5. With reference to FIGS. 5, 6, and 8, the tool body 262 can be advanced to impart a preload force against the pack off 130 and ultimately the intermediate casing 30. In some embodiments, the tool body 262 can be moved hydraulically. As illustrated, hydraulic fluid can actuate a piston 268 to move the tool body 262. For example, hydraulic fluid introduced into chamber 269*a* can move the piston 268 downward, causing the tool body 262 to impart a preload force against the intermediate casing 30.

After the retaining ring 150 is released and the intermediate casing 30 is separated from the wellhead 110, the compression relief tool 260 can release the compressive force on the intermediate casing 30. In the depicted example, the tool body 262 of the compression relief tool 260 can be retracted relative to the wellhead 110 and adapter 214 to allow the intermediate casing 30 expand in a controlled manner or predetermined rate. In some embodiments, hydraulic fluid can actuate a piston 268 to move the tool body 262 to release the compressive force stored in the intermediate casing 30. During operation, hydraulic fluid introduced into chamber 269*b* can move the piston 268 upward, causing the tool body 262 and intermediate casing 30 to move upward. In some embodiments, hydraulic pressure in chamber 269*a* may be released, allowing stored compressive energy in the intermediate casing 30 to move the piston 268 upward in a controlled matter or predetermined rate. As illustrated, the intermediate casing 30 can rise relative to the wellhead 110 and adapter 214.

Figure 9:
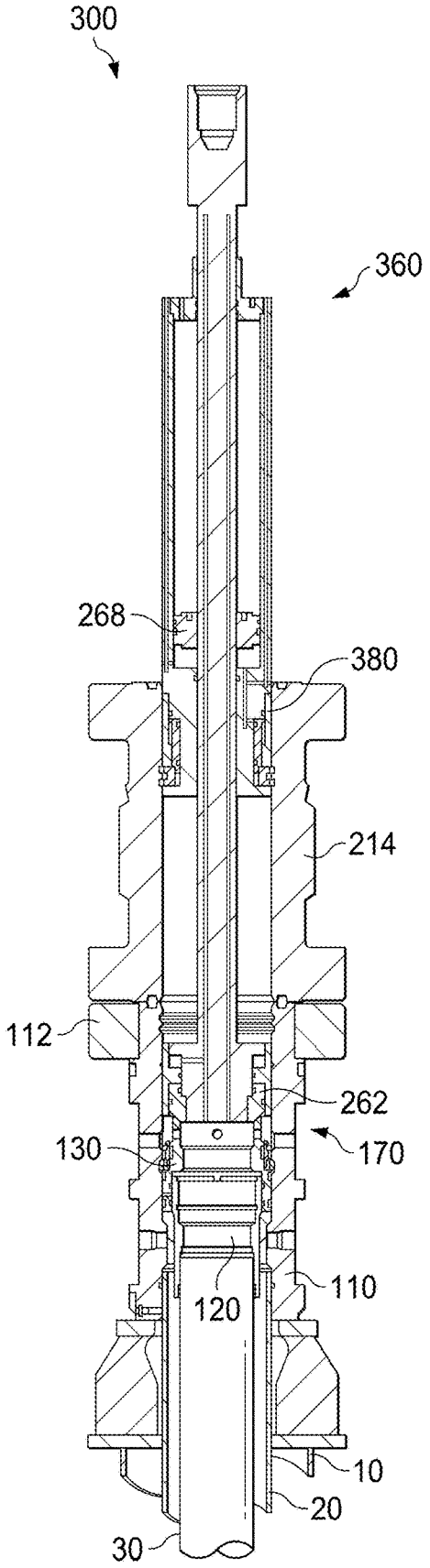
FIG. 9 is a cross-sectional view of an example configuration of a wellhead system, in accordance with embodiments of the present disclosure.

FIG. 9 is a cross-sectional view of an example configuration of a wellhead system 300, in accordance with embodiments of the present disclosure.

Figure 10:
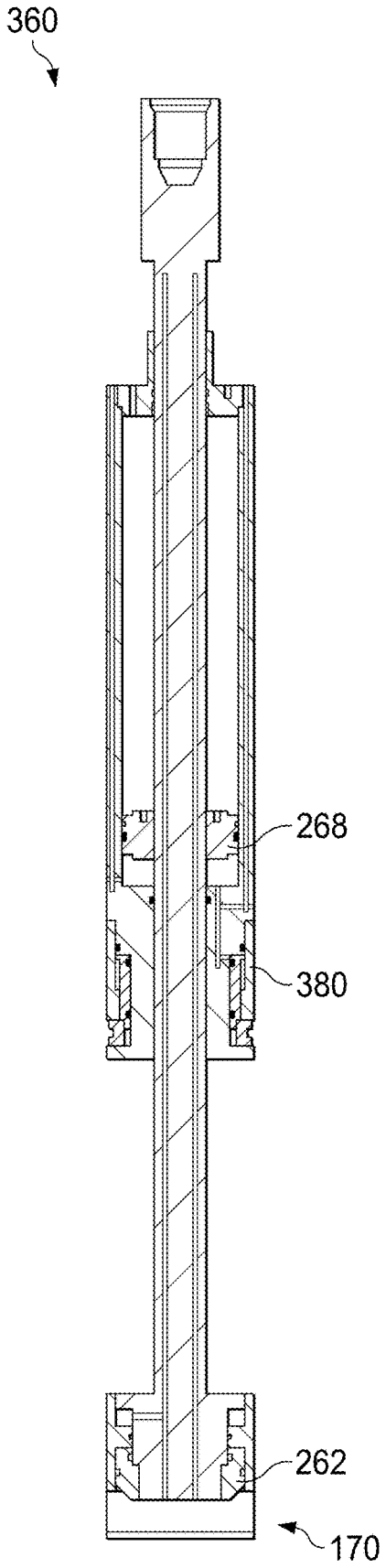
FIG. 10 is a cross-sectional view of the release tool depicted in FIG. 9.

FIG. 10 is a cross-sectional view of the compression relief tool 360 depicted in FIG. 9. As described herein, the compression relief tool 360 can be hydraulically coupled to the adapter 214. In some applications, certain features of the compression relief tool 360 are similar to the features of the compression relief tool 260 and may be referenced with similar reference numerals.

Figure 11:
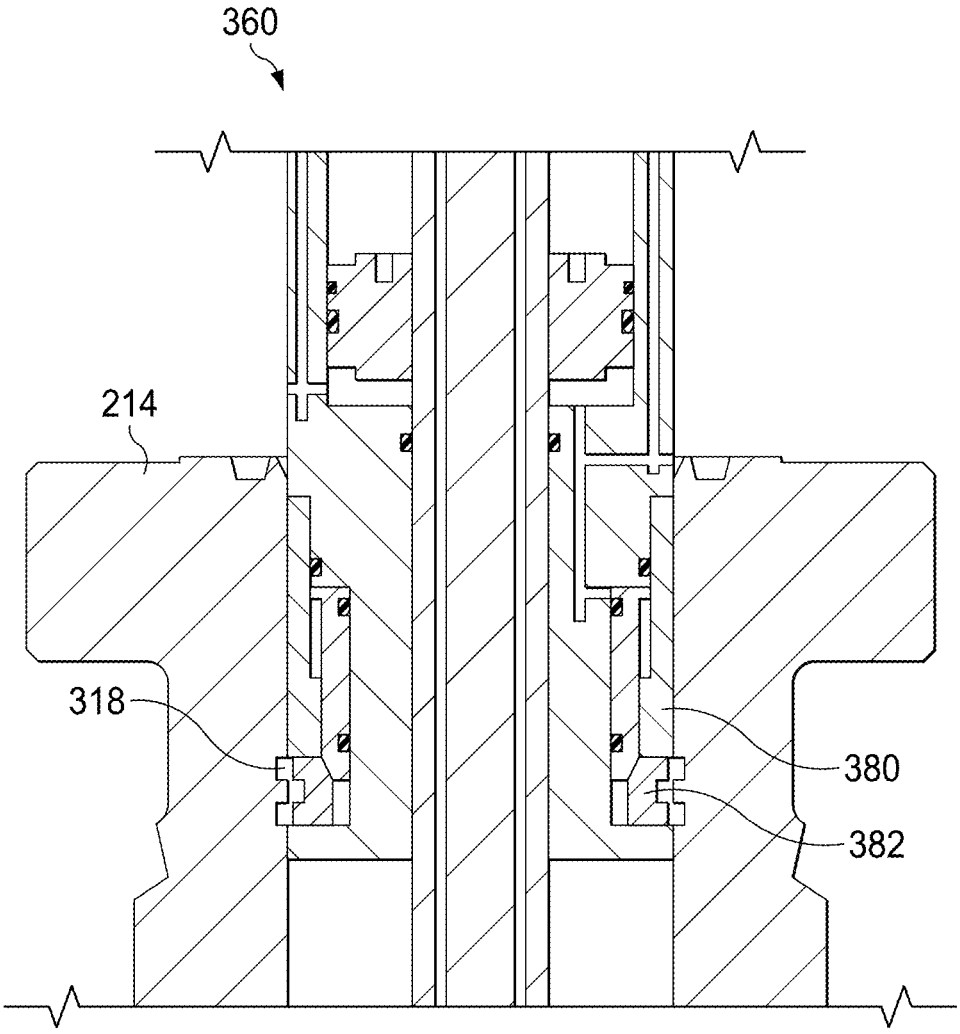
FIG. 11 is a cross-sectional detail view of the release tool depicted in FIG. 9.

FIG. 11 is a cross-sectional detail view of the compression relief tool 360 depicted in FIG. 9. With reference to FIGS. 9-11, the compression relief tool 360 can be hydraulically coupled to the adapter 214. As illustrated, the compression relief tool 360 can be deployed through an opening or cavity of the adapter 214 and coupled to the adapter 214 using hydraulic locking mechanism 380. In the depicted example, after the compression relief tool 360 is deployed, the hydraulic locking mechanism 380 can be hydraulically actuated to engage locking members 382 against an inner diameter of the adapter 214. As illustrated, the locking members 382 can engage or lockdown within mating grooves 318 of the adapter 214 to secure or retain the compression relief tool 360 relative to the adapter 214 and the wellhead 110.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A compression relief tool, comprising:

a tool body configured to couple to a wellhead;

an actuator coupled to the tool body and configured to impart a preload force on an intermediate casing via the tool body; and a tool sleeve movable relative to the tool body, wherein the tool sleeve is configured to release a lock ring from the intermediate casing and the actuator is configured to release the preload force on the intermediate casing after the tool sleeve releases the lock ring.

2. The compression relief tool of claim 1, wherein the tool sleeve is configured to engage a retaining ring coupled to the intermediate casing and the tool sleeve is movable to retrieve the retaining ring from the intermediate casing.

3. The compression relief tool of claim 2, wherein the actuator is configured to release the preload force on the intermediate casing after the tool sleeve retrieves the retaining ring.

4. The compression relief tool of claim 2, wherein the retaining ring is inwardly biased.

5. The compression relief tool of claim 2, wherein the retaining ring is outwardly biased.

6. The compression relief tool of claim 2, wherein at least one of the retaining ring and the tool sleeve comprises collet fingers.

7. The compression relief tool of claim 1, wherein the tool body is configured to be coupled to the wellhead via a wellhead adapter coupled to the wellhead.

8. The compression relief tool of claim 7, wherein the actuator comprises a hydraulic piston.

9. The compression relief tool of claim 8, further comprising lockdown screws configured to engage with mating notches formed in the tool body.

10. The compression relief tool of claim 8, further comprising a hydraulic locking mechanism configured to actuate locking members to engage mating grooves formed in the wellhead adapter.

11. The compression relief tool of claim 1, wherein the actuator is configured to release the preload force at a predetermined rate.

12. The compression relief tool of claim 1, wherein the actuator comprises threaded bolts configured to couple to a tool flange of the wellhead.

13. The compression relief tool of claim 12, further comprising a test port.

14. The compression relief tool of claim 12, further comprising a hydraulic piston configured to move the movable sleeve.

15. A method of compression relief, comprising the following steps:

coupling a tool body to a wellhead;

coupling an actuator to the tool body;

actuating the actuator to impart a preload force on an intermediate casing via the tool body;

moving a tool sleeve relative to the tool body to release a lock ring from the intermediate casing; and releasing the preload force on the intermediate casing after the tool sleeve releases the lock ring.

16. The method of claim 15, further comprising the following steps:

using the tool sleeve to engage a retaining ring coupled to the intermediate casing; and moving the tool sleeve to retrieve the retaining ring from the intermediate casing.

17. The method of claim 15, wherein the actuator comprises threaded bolts configured to couple to a tool flange of the wellhead.

18. The compression relief tool of claim 17, further comprising a hydraulic piston configured to move the movable sleeve.

19. The method of claim 15, wherein the tool body is configured to be coupled to the wellhead via a wellhead adapter coupled to the wellhead.

20. The method of claim 19, wherein the actuator comprises a hydraulic piston.

* * * * *